US006139428A

United States Patent [19]

Drill et al.

[11] Patent Number: 6,139,428

[45] **Date of Patent: *Oct. 31, 2000**

[54] CONDITIONING RING FOR USE IN A CHEMICAL MECHANICAL POLISHING MACHINE

[75] Inventors: Charles Franklin Drill, Boulder Creek; Milind Ganesh Weling, San Jose, both of Calif.

[73] Assignee: VSLI Technology, Inc., San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/768,043

[22] Filed: Dec. 17, 1996

[51] Int. Cl.[7] ..... B24B 1/00

[52] U.S. Cl. ..... 457/41; 451/286; 451/288; 451/56; 451/443

[58] Field of Search ..... 451/285–290, 451/443, 41, 444, 56, 364; 156/345

[56] References Cited

U.S. PATENT DOCUMENTS

| | | | |
|---|---|---|---|
| 5,584,751 | 12/1996 | Kobayashi et al. | 451/41 |
| 5,681,212 | 10/1997 | Hayakawa et al. | 451/364 |
| 5,695,392 | 12/1997 | Kim | 451/41 |
| 5,749,771 | 5/1998 | Isobe | 451/56 |
| 5,916,412 | 6/1999 | Nakashiba et al. | 156/345 |

FOREIGN PATENT DOCUMENTS

| | | | |
|---|---|---|---|
| 363283859 | 11/1988 | Japan | 451/288 |

*Primary Examiner*—David A. Scherbel
*Assistant Examiner*—George Nguyen
*Attorney, Agent, or Firm*—Wagner, Murabito & Hao LLP

[57] ABSTRACT

The present invention is a conditioning ring for conditioning a polishing pad in a chemical-mechanical polishing machine. The conditioning ring is comprised of a ring having a diameter and a conditioning surface substantially parallel to a plane defined by the diameter. The conditioning ring has an inner radius surface to the plane defined by the diameter, wherein the inner radius surface is adapted to accept a wafer. The conditioning ring has an outer radius surface opposite the inner radius surface and an upper surface opposite the conditioning surface. The chemical mechanical polishing machine polishes the wafer by moving the polishing pad with respect to the wafer while the wafer is in contact with the polishing pad. The conditioning surface is adapted to frictionally contact the polishing pad. The conditioning surface conditions the polishing pad in response to a down force applied to the conditioning ring and as the chemical-mechanical polishing machine moves the polishing pad in relation to the conditioning surface.

14 Claims, 7 Drawing Sheets

FIG. 4A
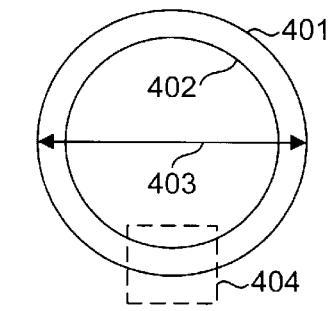
FIG. 4B
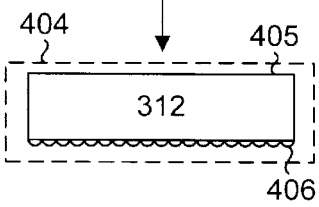
FIG. 4C
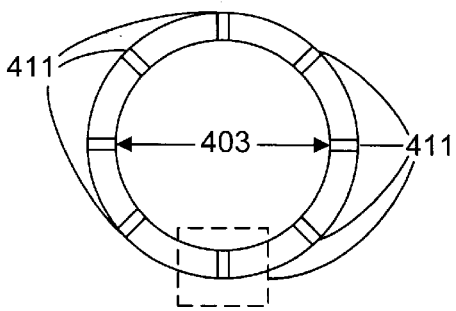
FIG. 4D
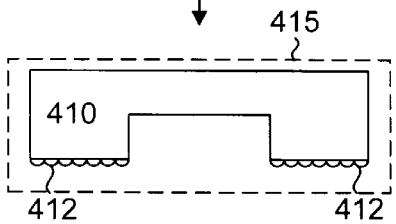
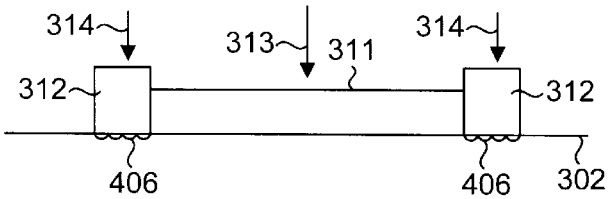
FIG. 5A
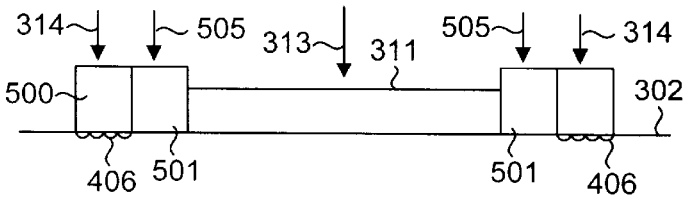
FIG. 5B

CONDITIONING RING FOR USE IN A CHEMICAL MECHANICAL POLISHING MACHINE

TECHNICAL FIELD

The field of the present invention pertains to semiconductor fabrication processing. More particularly, the present invention relates to a device for retaining a semiconductor wafer in a chemical-mechanical polishing machine.

BACKGROUND ART

Most of the power and usefulness of today's digital IC devices can be attributed to the increasing levels of integration. More and more components (resistors, diodes, transistors, and the like) are continually being integrated into the underlying chip, or IC. The starting material for typical ICs is very high purity silicon. The material is grown as a single crystal. It takes the shape of a solid cylinder. This crystal is then sawed (like a loaf of bread) to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built up layers, each layer having components, each layer having differing interconnections, and each layer stacked on top of the previous layer. The resulting topography of these complex IC's often resemble familiar terrestrial "mountain ranges", with many "hills" and "valleys" as the IC components are built up on the underlying surface of the silicon wafer.

In the photolithography process, a mask image, or pattern, defining the various components, is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer, i.e. optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, the "hills" and "valleys," exaggerate the effects of decreasing depth of focus. Thus, in order to properly focus the mask image defining sub-micron geometries onto the photosensitive layer, a precisely flat surface is desired. The precisely flat (i.e. fully planarized) surface will allow for extremely small depths of focus, and in turn, allow the definition and subsequent fabrication of extremely small components.

Chemical-mechanical polishing (CMP) is the preferred method of obtaining full planarization of a wafer. It involves removing a sacrificial layer of dielectric material using mechanical contact between the wafer and a moving polishing pad with chemical assistance from a polishing slurry. Polishing flattens out height differences, since high areas of topography (hills) are removed faster than areas of low topography (valleys). Polishing is the only technique with the capability of smoothing out topography over millimeter scale planarization distances leading to maximum angles of much less than one degree after polishing.

FIG. 1A shows a down view of a CMP machine 100 and FIG. 1B shows a side cut away view of the CMP machine 100 taken through line AA. The CMP machine 100 is fed wafers to be polished. The CMP machine 100 picks up the wafers with an arm 101 and places them onto a rotating polishing pad 102. The polishing pad 102 is made of a resilient material and is textured, often with a plurality of predetermined groves 103, to aid the polishing process. The polishing pad 102 rotates on a platen 104, or turn table located beneath the polishing pad 102, at a predetermined speed. A wafer 105 is held in place on the polishing pad 102 and the arm 101 by a carrier ring 112 and a carrier 106. The lower surface of the wafer 105 rests against the polishing pad 102. The upper surface of the wafer 105 is against the lower surface of the carrier 106 of the arm 101. As the polishing pad 102 rotates, the arm 101 rotates the wafer 105 at a predetermined rate. The arm 101 forces the wafer 105 into the polishing pad 102 with a predetermined amount of down force. The CMP machine 100 also includes a slurry dispense arm 107 extending across the radius of the polishing pad 102. The slurry dispense arm 107 dispenses a flow of slurry onto the polishing pad 102.

The slurry is a mixture of de ionized water and polishing agents designed to chemically aid the smooth and predictable planarization of the wafer. The rotating action of both the polishing pad 102 and the wafer 105, in conjunction with the polishing action of the slurry, combine to planarize, or polish, the wafer 105 at some nominal rate. This rate is referred to as the removal rate. A constant and predictable removal rate is important to the uniformity and performance of the wafer fabrication process. The removal rate should be expedient, yet yield precisely planarized wafers, free from surface topography. If the removal rate is too slow, the number of planarized wafers produced in a given period of time decreases, degrading wafer through-put of the fabrication process. If the removal rate is too fast, the CMP planarization process will not be uniform across the surface of the wafers, degrading the yield of the fabrication process.

To aid in maintaining a stable removal rate, the CMP machine 100 includes a conditioner assembly 120. The conditioner assembly 120 includes a conditioner arm 108, which extends across the radius of the polishing pad 102. An end effector 109 is connected to the conditioner arm 108. The end effector 109 includes an abrasive conditioning disk 110 which is used to roughen the surface of the polishing pad 102. The conditioning disk 110 is rotated by the conditioner arm 108 and is translationally moved towards the center of the polishing pad and away from the center of the polishing pad 102, such that the conditioning disk 110 covers the radius of the polishing pad 102, thereby covering nearly the entire surface area of the polishing pad 102 as the polishing pad 102 rotates. A polishing pad having a roughened surface has an increased number of very small pits and gouges in its surface from the conditioner assembly 120 and therefore produces a faster removal rate via increased slurry transfer to the surface of the wafer and from more effective application of polishing down force. Without conditioning, the surface of polishing pad 102 is smoothed during the polishing process and removal rate decreases dramatically. The conditioner assembly 120 re-roughens the surface of the polishing pad 102, thereby improving the transport of slurry and improving the removal rate.

Referring still to FIG. 1A and FIG. 1B, the polishing action of the slurry determines the removal rate and removal rate uniformity, and thus, the effectiveness of the CMP process. As slurry is "consumed" in the polishing process, the transport of fresh slurry to the surface of the wafer 105 and the removal of polishing by-products away from the surface of the wafer 105 becomes very important in maintaining the removal rate. Slurry transport is facilitated by the texture of the surface of the polishing pad 102. This texture is comprised of both predefined pits and grooves 103 that are manufactured into the surface of the polishing pad 102 and the inherently rough surface of the material from which the polishing pad 102 is made.

To maintain the required degree of roughness in the surface of the polishing pad 102, the conditioner assembly 120 re-roughens the surface of the polishing pad 102 to counteract the smoothing effect of friction with the wafer 105. Without active conditioning by the conditioner assembly 120, the textured surface of the polishing pad 102 is quickly worn down and smoothed. The abrasive action of the slurry, the frictional contact with the wafer 105, and the frictional contact with the carrier ring 112, all combine to smooth away the needed texture of the surface of the polishing pad. Thus, the additional element, the conditioner assembly 120, is included on CMP machine 100, because without active conditioning, the surface of polishing pad 102 is smoothed and removal rate decreases dramatically.

Referring now to FIG. 2A, FIG. 2B, FIG. 2C and FIG. 2D, the relationship between the wafer, a carrier ring, and a polishing pad are shown (for teaching purposes, the above elements are not necessarily drawn to scale). FIG. 2A and FIG. 2B show a wafer 105 and a carrier ring 112 respectively. FIG. 2C and FIG. 2D show a side view of the wafer 105 in the carrier ring 112 on a polishing pad 102. As described above, the wafer 105 is held in place on the arm (not shown) by the carrier ring 112 as the polishing pad 102 rotates on the polishing platen. The carrier ring 112 accepts the wafer 105 within its inner radius surface 201. The upper surface of the wafer 105 is against the carrier 106 (not shown) of the arm. The carrier 106 (not shown) presses the wafer into the polishing pad with a predetermined force. As the polishing pad 102 rotates, carrier 106 (not shown) rotates the wafer 105.

Referring still to FIG. 2D, the wafer 105 typically protrudes slightly, relative to the lower surface of carrier ring 112. This gives the polishing pad 102 and the slurry (not shown) on the polishing pad 102 an even contact with wafer 105. The carrier ring 112 holds the wafer 105 in place while the polishing pad 102 and slurry polish the wafer 105. Polishing pad 102 frictionally slides against the lower surface of carrier ring 112 and against wafer 105. The predetermined amount of down force increases the friction between polishing pad 102, carrier ring 112, and wafer 105, thus, increasing the removal rate while at the same time increasing the rate at which the texture of the polishing pad is worn away and smoothed.

Thus, in CMP machines in accordance with the prior art, an additional element, the conditioner assembly 120, needs to be included, because without active conditioning, the surface of polishing pads used with the CMP machines are quickly smoothed. As described above, the conditioner assembly included with a prior art CMP machine is important to maintaining a stable removal rate. As such, the conditioner assembly needs to be carefully calibrated in order to obtain optimum CMP performance (e.g., the areas on the surface of the polishing pad which receive conditioning need to be aligned with the areas on the surface which frictionally contact the wafer). Additionally, the cost of the hardware involved in fabricating the conditioner assembly itself is substantial. If a method where devised which eliminates the need for a separate conditioner assembly included on the CMP machine, costs involved in setting up, calibrating, and maintaining fabrication lines using CMP machines would be lower.

Thus, what is desired is a system which improves the performance of a polishing pad in a CMP machine. What is further desired is a system which maintains a higher removal rate by conditioning the polishing pad in the CMP machine, yet is not burdened with the expense and maintenance requirements of a separate conditioner assembly. What is further desired is a system which ensures the areas on the surface of the polishing pad which receive conditioning are aligned with the areas on the surface which frictionally contact the wafer. The system should also be adapted to counter the added smoothing effects an additional amount of down force, applied to the upper surface of the wafer and carrier ring, has on the surface of the polishing pad. The present invention provides a solution to the above needs.

DISCLOSURE OF THE INVENTION

The present invention is a conditioning ring for conditioning a polishing pad in a chemical-mechanical polishing machine. The conditioning ring is comprised of a ring having a diameter and a lower surface substantially parallel to a plane defined by the diameter. The conditioning ring has an inner radius surface substantially orthogonal to the plane defined by the diameter, wherein the inner radius surface is adapted to accept a wafer. The conditioning ring has an outer radius surface opposite the inner radius surface and an upper surface opposite the lower surface. On the lower surface, a conditioner surface is mounted and is adapted to frictionally contact the polishing pad. The conditioning surface conditions the polishing pad as the chemical-mechanical polishing machine moves the polishing pad in relation to the conditioner surface, while polishing the wafer. Thus, the conditioning ring of the present invention improves the performance of a polishing pad in a CMP machine.

Additionally, the present invention provides a system which maintains a higher removal rate (e.g., rate at which the wafer is planarized) by conditioning the polishing pad. In so doing, the added expense and maintenance requirements of a separate conditioner assembly can be eliminated. Since the wafer fits within the diameter of the conditioning ring of the present invention, the conditioning ring inherently ensures the areas on the surface of the polishing pad which receive conditioning are aligned with the areas on the surface of the polishing pad which fictionally contact the wafer. As a further benefit, the conditioning ring of the present invention effectively counters an additional smoothing effect created when the CMP machine uses an additional amount of down force applied to the upper surface of the wafer.

In another embodiment, the present conditioning ring is used in combination with the separate conditioner assembly. In this embodiment the conditioning ring conditions the polishing pad in conjunction with the conditioning action of the separate conditioner assembly. To tailor conditioning performance, different types of conditioning surfaces can be employed on the conditioning ring (e.g., different grits, different abrasives, different conditioner surface materials, or the like), the separate conditioner assembly, or both.

BRIEF DESCRIPTION OF THE DRAWINGS

The present invention is illustrated by way of example and not by way of limitation, in the figures of the accompanying drawings and in which like reference numerals refer to similar elements and in which:

FIG. 4A shows a down view of a conditioning ring in accordance with one embodiment of the present invention.

FIG. 4B shows a side view of an enlarged portion of the conditioning ring of FIG. 4A.

FIG. 4C shows a ventilated conditioning ring in accordance with another embodiment of the present invention.

FIG. 4D shows a side view of an enlarged portion of the conditioning ring of FIG. 4C.

FIG. 5A shows a side cut away view of the conditioning ring 312 in use.

FIG. 5B shows a side cut away view of a conditioning ring in accordance with another embodiment of the present invention.

BEST MODE FOR CARRYING OUT THE INVENTION

A conditioning ring for use in a chemical-mechanical polishing machine is disclosed. In the following description, for the purposes of explanation, numerous specific details are set forth in order to provide a thorough understanding of the present invention. It will be obvious, however, to one skilled in the art that the present invention may be practiced without these specific details. In other instances, well-known structures, devices, and processes are shown in block diagram form in order to avoid unnecessarily obscuring the present invention.

Chemical-mechanical polishing (CMP) is the preferred method of obtaining full planarization of a semiconductor wafer containing devices for fabrication processing. The CMP process involves removing a sacrificial layer of dielectric material using mechanical contact between the wafer and a moving polishing pad saturated with a polishing slurry. Polishing through the CMP process flattens out height differences, since high areas of topography (hills) are removed faster than areas of low topography (valleys). The CMP process is the preferred technique with the capability of smoothing out topography over millimeter scale planarization distances leading to maximum angles of much less than one degree after polishing.

The present invention comprises a conditioning ring for use in a CMP machine. The conditioning ring includes a ring having a diameter and a lower surface substantially parallel to a plane defined by the diameter. The conditioning ring has an inner radius surface substantially orthogonal to the plane defined by the diameter, wherein the inner radius surface is adapted to accept a wafer. The conditioning ring has an outer radius surface opposite the inner radius surface and an upper surface opposite the lower surface. On the lower surface, a conditioner surface is mounted and is adapted to frictionally contact the polishing pad in a CMP machine. The CMP machine polishes the wafer by frictionally moving the polishing pad with respect to the wafer. In so doing, the polishing pad is conditioned by the conditioner surface as the polishing pad moves with respect to the conditioner surface. Thus, when the CMP machine polishes the wafer with the polishing pad, the conditioning ring of the present invention conditions the surface of the polishing pad. The present invention and its benefits are described in greater detail below.

Figure 1A:
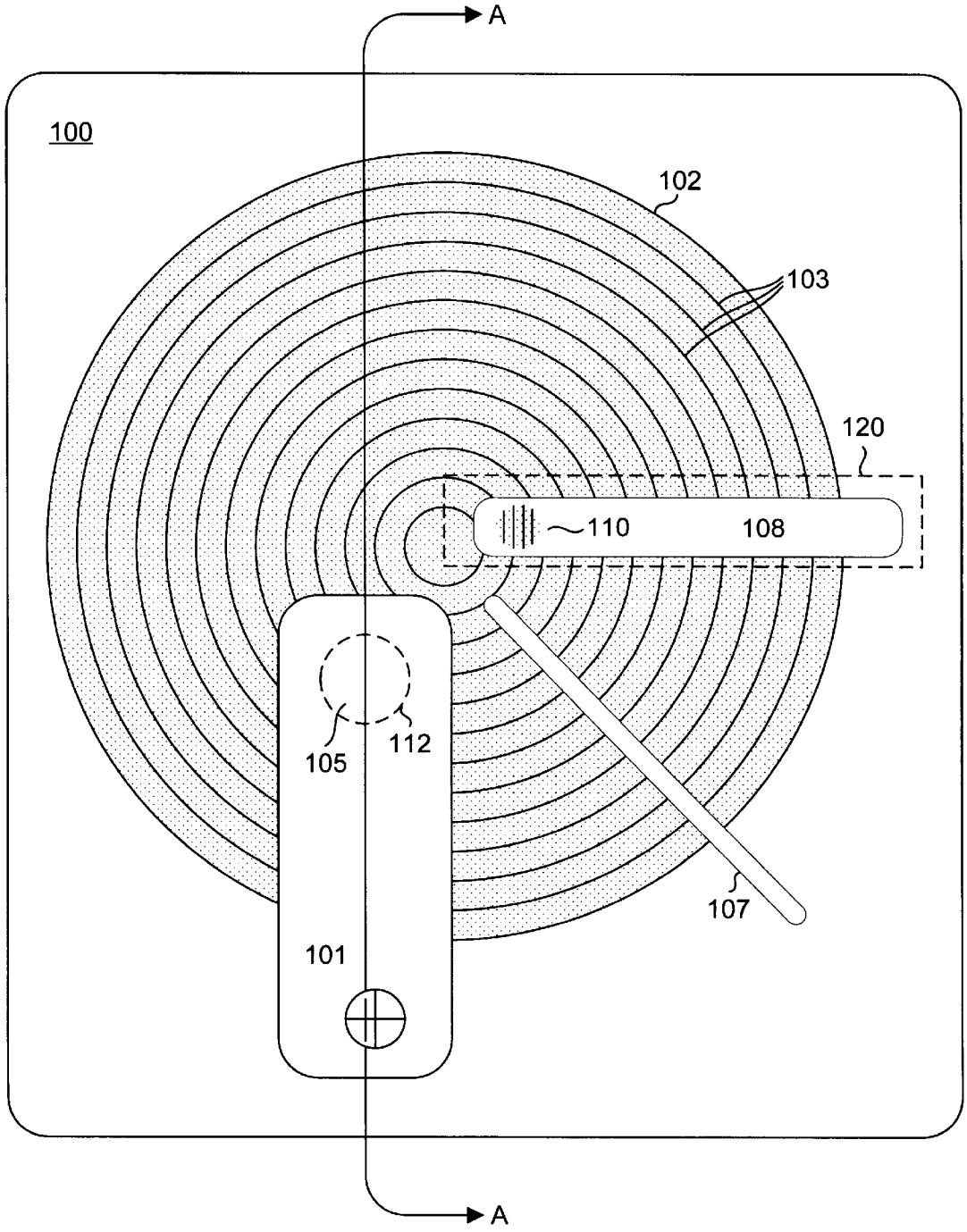
FIG. 1A (Prior Art)
FIG. 1A shows a down view of a prior art CMP machine.
Figure 1B:
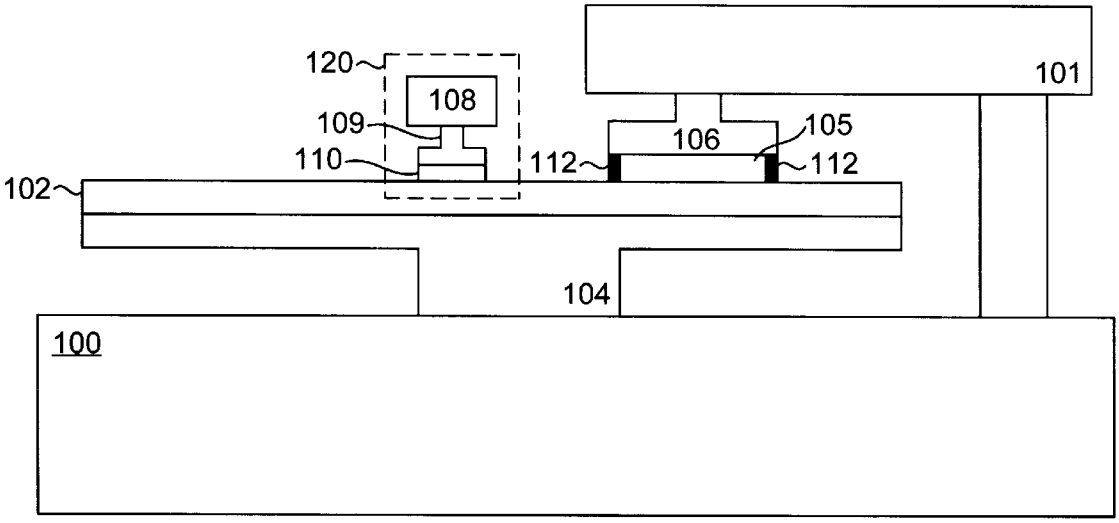
FIG. 1B (Prior Art)
FIG. 1B shows a side cut away view of the prior art CMP machine of FIG. 1A.
Figure 2A:
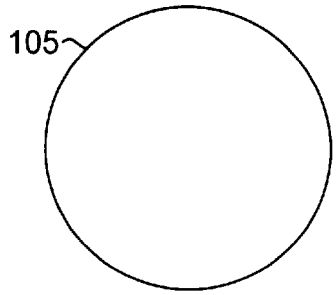
FIG. 2A (Prior Art)
FIG. 2A shows a prior art wafer.
Figure 2B:
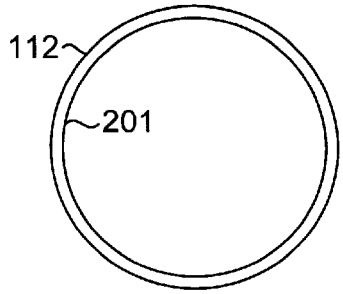
FIG. 2B (Prior Art)
FIG. 2B shows a prior art carrier ring.
Figure 2C:
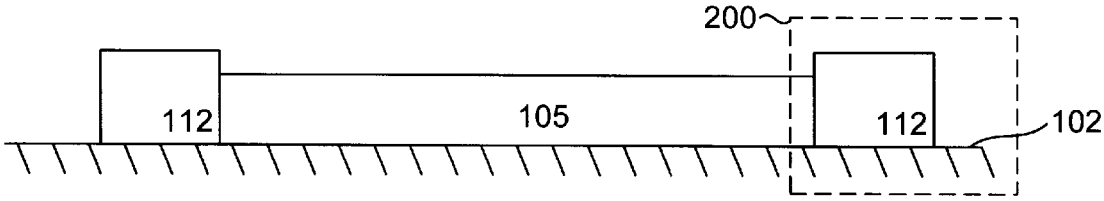
FIG. 2C (Prior Art)
FIG. 2C shows a side cut away view of a prior art wafer and carrier ring on a polishing pad.
Figure 2D:
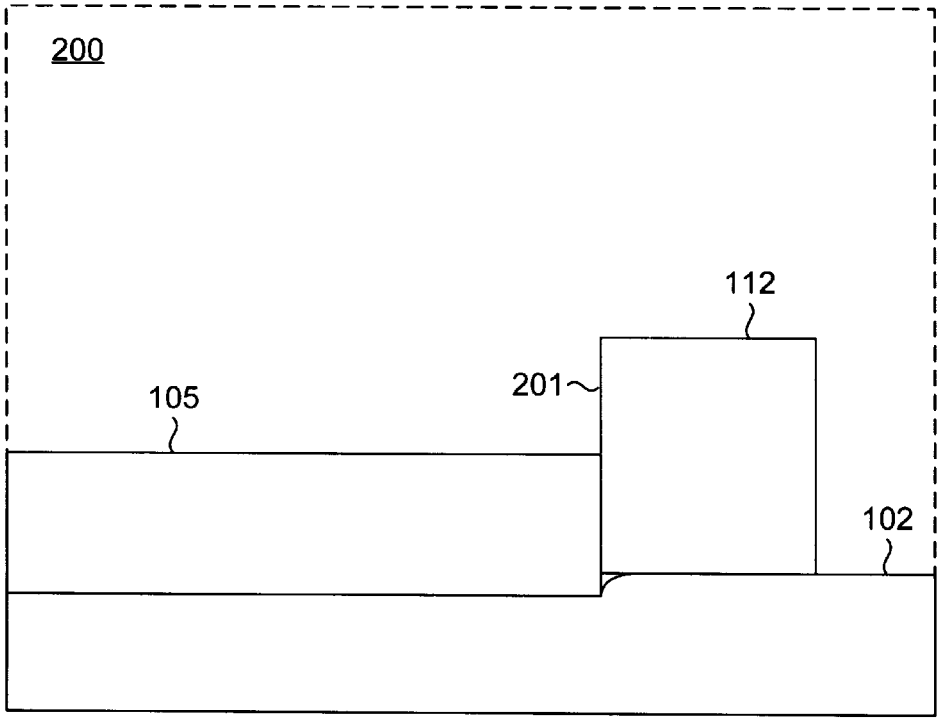
FIG. 2D shows an enlarged portion of the side cut away view of the prior art wafer, carrier ring, and polishing pad of FIG. 2C.
Figure 3A:
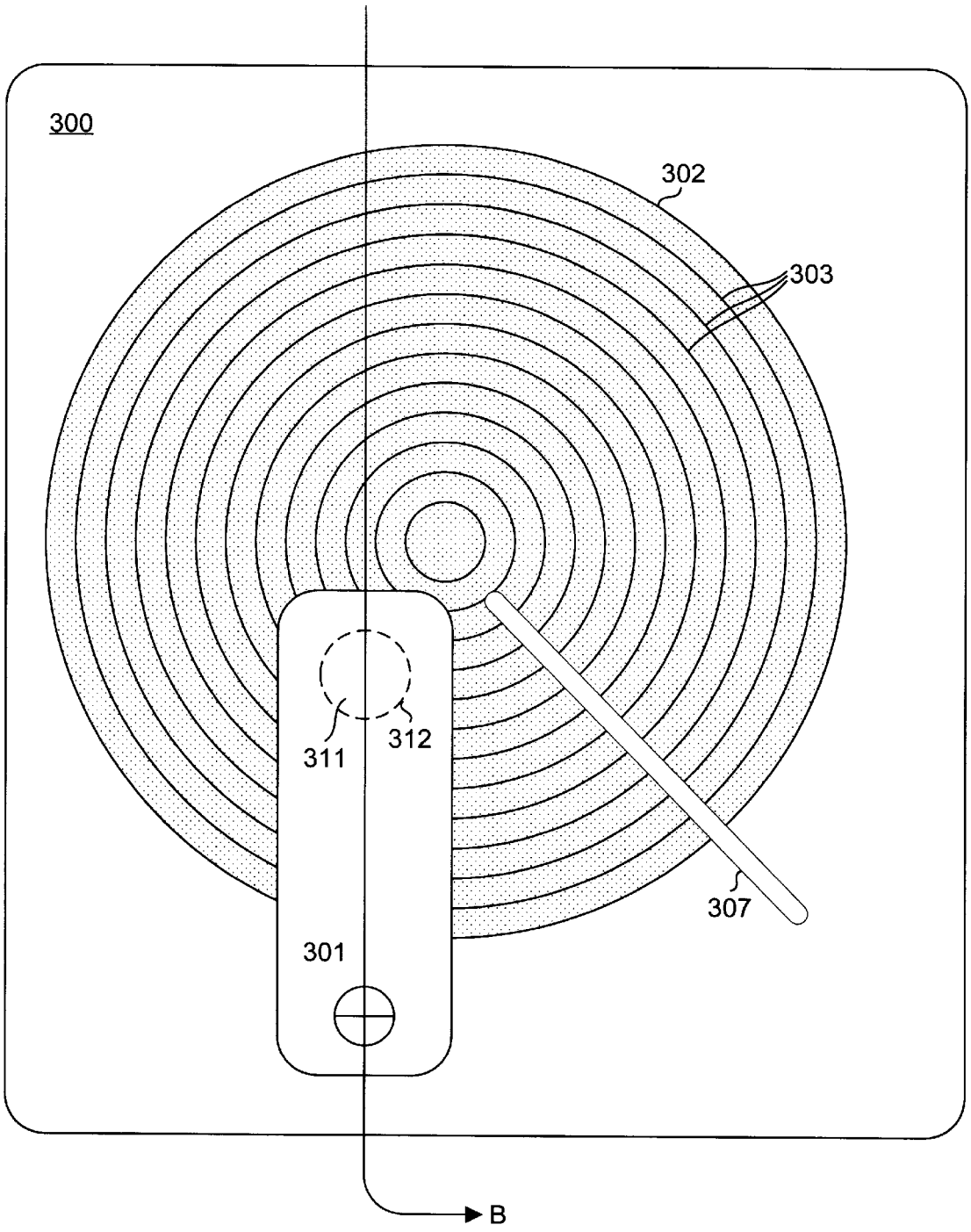
FIG. 3A shows a down view of a CMP machine in accordance with one embodiment of the present invention.
Figure 3B:
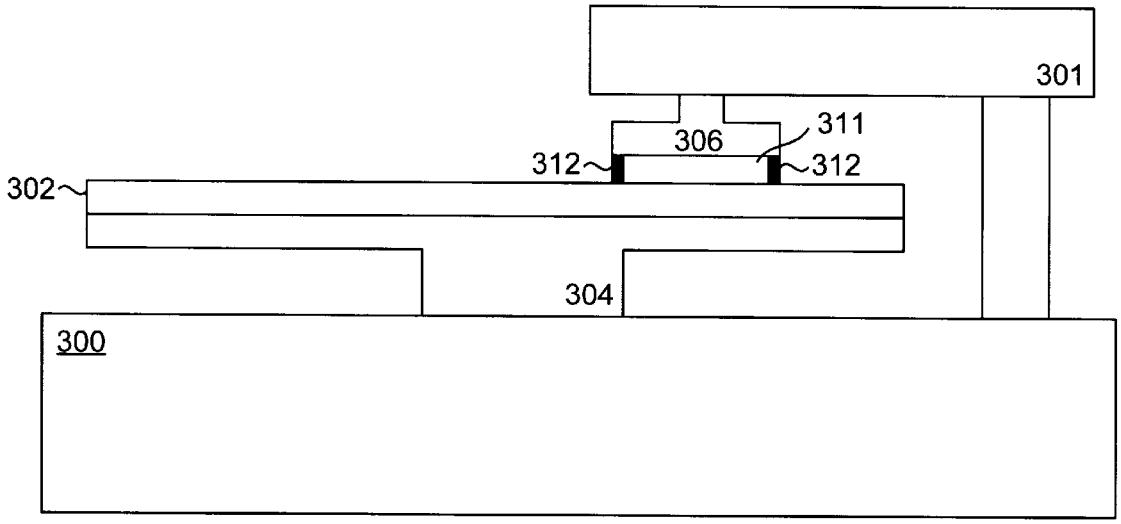
FIG. 3B shows a side cut away view of the CMP machine of FIG. 3A.

Referring now to FIG. 3A, a down view of a CMP machine 300 in accordance with the present invention is shown, and FIG. 3B shows a side cut-away view of the CMP machine 300 taken through line B—B. The CMP machine 300 picks up wafers with an arm 301 and places them onto rotating polishing pad 302. The polishing pad 302 is made of a resilient material and is textured with a plurality of groves 303 to aid the polishing process. The polishing pad 302, of CMP machine 300, rotates on a platen 304, or turn table located beneath the polishing pad 302, at a predetermined speed. The arm 301 forces a wafer 311 into the polishing pad 302 with a predetermined amount of down force. The wafer 311 is held in place on the polishing pad 302 and the arm 301 by a conditioning ring 312 and a carrier 306. The lower surface of the wafer 311 rests against the polishing pad 302. The upper surface of the wafer 311 is against the lower surface of the carrier 306 of the arm 301. As the polishing pad 302 rotates, the arm 301 rotates the wafer 311 at a predetermined rate. The CMP machine 300 also includes a slurry dispense arm 307 extending across the radius of the polishing pad 302. The slurry dispense arm 307 dispenses a flow of slurry onto the polishing pad 302.

The slurry is a mixture of de ionized water and polishing agents designed to chemically aid the smooth and predictable planerization of the wafer. The rotating action of both the polishing pad 302 and the wafer 311, in conjunction with the polishing action of the slurry, combine to planerize, or polish, the wafer 311 at some nominal rate. This rate is referred to as the removal rate. A constant and predictable removal rate is important to the uniformity and performance of the wafer fabrication process. The removal rate should be expedient, yet yield precisely planarized wafers, free from surface anomalies. If the removal rate is too slow, the number of planarized wafers produced in a given period of time decreases, hurting wafer through-put of the fabrication process. If the removal rate is too fast, the CMP planarization process will not be uniform across the surface of the wafers, hurting the yield of the fabrication process.

The slurry adheres to the rough texture of the surface of the polishing pad 302 and is transported under the edges of the wafer 311 as both the polishing pad 302 and the wafer 311 rotate. Consumed slurry and polishing by-products, in a similar manner, also adhere to the surface of the polishing pad 302 and are transported away from the surface of the wafer 311. As the polishing process continues, fresh slurry is continually dispensed onto the polishing pad from the slurry dispense arm 307. The polishing process continues until the wafer 311 is sufficiently planarized and removed from the polishing pad 302.

It should be appreciated that CMP machine 300 does not include a conditioner assembly. To maintain the required degree of roughness in the surface of the polishing pad 302, CMP machine 300 includes the conditioning ring 312 of the present invention. The conditioning ring 312 re-roughens the surface of the polishing pad 302 to counteract the smoothing effect of friction with the wafer 311. The wafer 311 is held in place on the polishing pad 302 and on the carrier 306 by the conditioning ring 312. In so doing, the conditioning ring of the present invention performs the function of the prior art carrier ring. In addition, the conditioning ring re-roughens (i.e., conditions) the surface of the polishing pad 302, thereby performing the dual function of the separate conditioner assembly.

In so doing the conditioning ring of the present invention conditions the surface of the polishing pad 302 and thus counteracts the smoothing effect of friction between the polishing pad 302 and the wafer 311. The conditioning ring 312 of the present invention effectively prevents the textured surface of the polishing pad 302 from being quickly worn down and smoothed. By maintaining a stable amount of texture on the surface of polishing pad 302, the conditioning ring 312 of the present invention ensures a higher, stable, and predictable removal rate over a longer period of time. This reduces the amount of time required to polish wafers (e.g., wafer 311) to the required degree of planarity, thus, improving wafer fabrication through put. The conditioning ring of the present invention also improves the performance of polishing pads (e.g., polishing pad 302) used in CMP machines. Polishing pad 302 can remain in use, mounted on CMP machine 300, for a longer period of time before CMP processing is interrupted for polishing pad change out, again, improving wafer fabrication throughput.

In prior art CMP machines, a separate conditioner assembly was included to actively condition the surface of polishing pad 302. The conditioner assembly increased the maintenance requirements of prior art CMP machines due to the fact that the conditioner assembly needs careful calibration in order to perform optimally (e.g., the areas on the surface of the polishing pad which receive conditioning need to be aligned with the areas on the surface which frictionally contact the wafer). Additionally, the addition of a conditioner assembly added to the cost of the hardware involved in fabricating the prior art CMP machine. The conditioning ring 312 of the present invention eliminates the need for a separate conditioner assembly, and thus, eliminates the costs involved in setting up, calibrating, and maintaining fabrication lines using CMP machines with separate conditioner assemblies. The smoothing effects of the abrasive action of the slurry and the frictional contact with the wafer 311 are actively countered by the frictional, conditioning contact of the carrier ring 112. Thus, the requirement for a separate conditioner assembly is effectively eliminated from the CMP machine 300, because the function of the conditioner assembly is performed by the conditioning ring of the present invention.

The conditioning ring 312 of the present invention further provides a system which ensures the areas on the surface of the polishing pad 302 which receive conditioning are aligned with the areas on the surface which frictionally contact the wafer 311. The wafer 311 is retained in place by the conditioning ring 312. Thus, all areas of the surface of the polishing pad 302 which contact the wafer, as the CMP machine 300 rotates the polishing platen 304 and wafer 311, are also frictionally contacted by the conditioning ring 312. The conditioned areas of the surface of polishing pad 302 are thus inherently aligned with the areas contacting the wafer 311.

Referring now FIG. 4A a down view of the conditioning ring 312 of one embodiment of the present invention is shown. Conditioning ring 312 has an outer radius surface 401 and an opposite inner radius surface 402. Both the surface 401 and the surface 402 are orthogonal to the plane defined by the diameter of the conditioning ring 312, wherein the diameter is represented by line 403.

Referring now to FIG. 4B, an enlarged side view of a portion 404 of conditioning ring 312 from FIG. 4A is shown. Conditioning ring 312 has an upper surface 405 and an opposite conditioning surface 406, both of which are parallel to the plane defined by the diameter 403. The conditioning surface 406 is comprised of a plurality of small diamond embedded conditioning blades. The blades are embedded into the material of the conditioning ring to form the conditioning surface 406. Conditioning ring 312 is a solid, non-ventilated conditioning ring in that the outer radius surface 401 and the inner radius surface 402 are smooth and unbroken.

Referring to FIG. 4C and FIG. 4D, a down view of a ventilated conditioning ring 410 and an enlarged side view of a portion 415 of the conditioning ring 410 are respectively shown. Conditioning ring 410 and conditioning ring 312 are essentially the same. In this embodiment, however, conditioning ring 410 includes a plurality of ventilation holes 411. The ventilation holes 411 aid the flow of slurry to a wafer (not shown) located within the diameter 403 of the conditioning ring 410. Conditioning ring 410 still includes a conditioning surface 412 which is substantially the same as the conditioning surface 406 of conditioning ring 312.

FIG. 5A shows a side cut away view of the conditioning ring 312 in use. Conditioning ring 312 rests against polishing pad 302 and confines the wafer 311. As the polishing pad 302 moves with respect to the wafer 311 and conditioning ring 312, the conditioning surface 406 frictionally contacts the polishing pad 302 and abrasively conditions the surface of polishing pad 302. To control the removal rate, an adjustable amount of down force, represented by arrow 313, is applied by the CMP machine to the wafer 311. The adjustable amount of down force presses the wafer 311 into the surface of polishing pad 302, increasing the polishing friction between wafer 311 and polishing pad 302. The increased polishing friction increases the removal rate. To maintain consistency of the polishing pad surface across the area of wafer 311, the CMP machine applies a separate adjustable amount of down force, represented by lines 314, to the conditioning ring 312. The separate adjustable down force (hereafter conditioning ring down force) presses conditioning ring 312 into the polishing pad 302. The conditioning ring down force could also be used to control the "rebound" effect of polishing pad 302. Without conditioning ring down force, polishing pad 302 rebounds around the edges of wafer 311, increasing friction around the edges, thereby causing non-uniform planarization. The conditioning ring down force 314 compensates for polishing pad rebound and helps maintain uniform planarization.

With carrier rings of the prior art, a down force applied to the carrier ring to compensate for polishing pad rebound increased the friction between the carrier ring and the polishing pad, increasing the rate at which the desirable texture of the polishing pad is smoothed away. With the conditioning ring of the present invention, however, a down force applied to the conditioning ring 312, e.g., conditioning ring down force 314, simply conditions the polishing pad 302, maintaining the required amount of texture or roughness. Thus, numerous combinations of down force 313 and conditioning ring down force 314 are possible without adversely affecting the required amount of texture or roughness of polishing pad 302.

Referring now to FIG. 5B, a conditioning ring 500 in accordance with another embodiment of the present invention is shown. Conditioning ring 500 is similar to conditioning ring 312, however, conditioning ring 500 is sized to accept a separate carrier ring 501 in addition to the wafer 311. Carrier ring 501 functions by confining wafer 311 in place on the surface of polishing pad 302, beneath the carrier (not shown) of the CMP machine. Conditioning ring 500 fits around the circumference of carrier ring 501 and between the carrier (not shown) and the polishing pad 302. In this implementation of the present invention, conditioning ring down force 314 functions in conjunction with a separate adjustable carrier ring down force, represented by arrows 505, to compensate for polishing pad rebound. Thus, conditioning ring down force 314, carrier ring down force 505, and adjustable down force 313 all combine to effect a uniform planarization of wafer 311. As described above, the conditioning surface 406 of conditioning ring 500 counteracts the smoothing effect of wafer 311. In addition, conditioning surface 406 is further adapted to counteract the smoothing effect of carrier ring 501. In this manner, conditioning ring 500 is readily utilized with industry standard carrier rings.

The conditioning ring 500 of the present invention may be sized to accommodate a broad range of carrier rings. In addition, more than one conditioning ring of the present invention may be utilized (e.g., one concentrically fitted around another), whether each has a separate amount of down force applied or not. As such, it should be appreciated that the conditioning ring of the present invention is easily adapted to use with CMP machines employing multiple conditioning rings, a conditioning ring and a carrier ring, or the like.

Although the conditioning ring of the present invention can eliminate the need for a separate conditioner assembly, as described above, the conditioning ring can be utilized in a CMP machines having a separate conditioner assembly. In such a CMP machine, the conditioning ring reduces the amount of smoothing the separate conditioner assembly needs to counteract. In addition, the nature of conditioning the polishing pad receives can be tailored, such that the conditioning action of the conditioning ring and the conditioning action of the separate conditioner assembly are complimentary.

Figure 6:
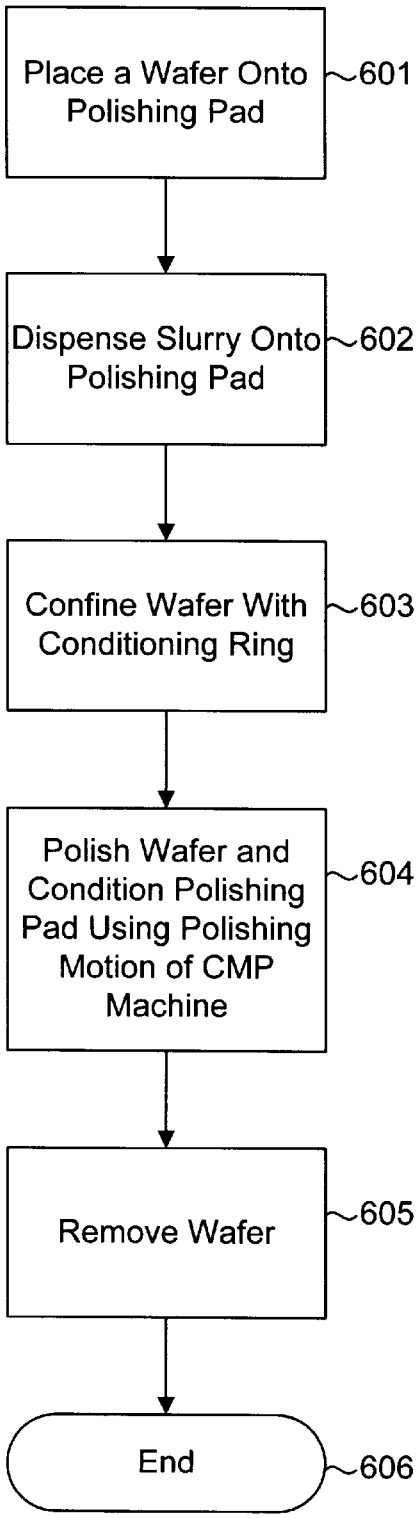
FIG. 6 shows a flow chart of the steps of the conditioning ring process of in accordance with one embodiment of the present invention.

Referring now to FIG. 6, a flow chart of the steps of the conditioning ring process 600 in accordance with one embodiment of the present invention is shown. Process 600 is used to polish wafers to the proper degree of planarization using the conditioning ring of the present invention. In step 601, an arm of a CMP machine grabs a wafer to be polished and places it onto a rotating polishing pad of the CMP machine. The polishing pad is previously coated with a layer of slurry. The slurry is dispensed from a slurry dispense arm, as described above. In step 602, a flow of slurry containing polishing agents is dispensed onto the polishing pad. This flow of slurry maintains the coating of slurry on the polishing pad.

In step 603, the wafer is confined by the conditioning ring of the present invention to the polishing pad as the polishing pad rotates. In step 604, the wafer is polished and the polishing pad is conditioned, in accordance with the process of the present invention. In addition to the polishing pad rotating, the wafer and conditioning ring is rotated by the arm, and the polishing process is carried out by the combined motion of both the polishing pad and the wafer. The friction of the wafer against the polishing pad, in conjunction with the action of the slurry, removes material from the wafer at a nominal removal rate. In addition, the polishing pad is roughened by a conditioning surface of the conditioning ring, in the manner described above. In step 605, the wafer is removed from the polishing pad when the polishing process is complete and the wafer is sufficiently planarized. The process subsequently ends in step 606.

Thus, the conditioning ring of the present invention improves the performance of a polishing pad in a CMP machine. The present invention provides a system which maintains a higher removal rate by conditioning the polishing pad. The expense and maintenance requirements of a separate conditioner assembly can be eliminated. The conditioning ring of the present invention ensures the areas on the surface of the polishing pad which receive conditioning are aligned with the areas on the surface of the polishing pad which frictionally contact the wafer. In addition, the conditioning ring of the present invention effectively counters an additional smoothing effect created when the CMP machine uses an additional amount of down force applied to the upper surface of the wafer.

The present invention, a conditioning ring for use in a chemical-mechanical polishing machine, is thus described. While the present invention has been described in particular embodiments, it should be appreciated that the present invention should not be construed as limited by such embodiments, but rather construed according to the below claims.

What is claimed is:

1. A conditioning carrier ring adapted for use with a chemical-mechanical polishing machine for polishing semiconductor wafers in a semiconductor device fabrication process, said conditioning carrier ring having an inner radius surface with a diameter, said diameter of said inner radius surface sized to accept a semiconductor wafer, said inner radius surface adapted to accept a second conditioning ring concentrically within said inner radius surface, an outer radius surface opposite said inner radius surface, an upper surface, and a lower surface opposite said upper surface, wherein said lower surface is a conditioning surface adapted to frictionally contact a polishing pad in a chemical-mechanical polishing machine, said conditioning surface adapted to condition said polishing pad as said chemical-mechanical semiconductor wafer polishing machine moves said conditioning surface with respect to said polishing pad while polishing said semiconductor wafer, the conditioning carrier ring having a substantially flat upper surface to accept a downforce from the chemical mechanical polishing machine onto the upper surface of the conditioning carrier ring to depress the surface of the polishing pad, wherein the downforce is independent of a downforce directed to the semiconductor wafer such that the conditioning carrier ring is vertically movable independent of the semiconductor wafer.

2. The conditioning carrier ring of claim 1, wherein said conditioning surface is adapted to maintain contact with said polishing pad and said conditioning surface permits an amount of slurry to pass, between said conditioning surface and said polishing pad, and into contact with said semiconductor wafer, said slurry adapted for use in chemical mechanical polishing of said semiconductor wafer.

3. The conditioning carrier ring of claim 1, further including a ventilation hole extending from said outer radius surface to said inner radius surface, said ventilation hole adapted to facilitate slurry flowing through said ventilation hole and into contact with said semiconductor wafer.

4. The conditioning carrier ring of claim 1, wherein said upper surface is adapted to receive a downward directed force from said chemical-mechanical semiconductor wafer polishing machine.

5. The conditioning carrier ring of claim 1, wherein said inner radius surface is orthogonally oriented with respect to said polishing pad surface.

6. The conditioning carrier ring of claim 1, wherein said conditioning surface includes a plurality of embedded abrasive particles adapted to abrasively roughen the surface material of said polishing pad.

7. A wafer polishing apparatus for polishing a wafer, comprising:

a) a polishing machine;

b) a polishing pad mounted on said polishing machine, said polishing pad adapted to perform a polishing motion, wherein said polishing machine implements said polishing motion;

c) a carrier arm mounted on said polishing machine, said carrier arm adapted to place a wafer onto said polishing pad; and d) a conditioning ring mounted on said carrier arm, said conditioning ring further comprising:

an inner radius surface having a diameter, said inner radius surface substantially orthogonal to a plane defined by said diameter, said inner radius surface adapted to accept a second conditioning ring concentrically within said inner radius surface;

an outer radius surface opposite said inner radius surface;

an upper surface substantially parallel to said plane defined by said diameter; and a lower surface opposite said upper surface, wherein said lower surface is a conditioning surface adapted to frictionally contact said polishing pad in said chemical-mechanical polishing machine such that said conditioning surface conditions said polishing pad as said chemical-mechanical polishing machine moves said conditioning surface with respect to said polishing pad, the conditioning carrier ring having a substantially flat upper surface to accept a downforce from the chemical mechanical polishing machine onto the upper surface of the conditioning carrier ring to depress the surface of the polishing pad, wherein the downforce is independent of a downforce directed to the semiconductor wafer such that the conditioning carrier ring is vertically movable independent of the semiconductor wafer.

8. The conditioning carrier ring of claim 7, wherein said conditioning surface is adapted to maintain contact with said polishing pad and said conditioning surface permits an amount of slurry to pass, between said conditioning surface and said polishing pad, into contact with said semiconductor wafer.

9. The conditioning carrier ring of claim 7, further including a ventilation hole extending from said outer radius surface to said inner radius surface, said ventilation hole adapted to facilitate slurry flowing through said ventilation hole and into contact with said semiconductor wafer, said slurry adapted for chemical mechanical polishing of said semiconductor wafer.

10. The conditioning carrier ring of claim 7, wherein said upper surface is adapted to receive a downward directed force from said chemical mechanical polishing machine.

11. The conditioning carrier ring of claim 7, wherein said inner radius surface is orthogonally oriented with respect to said polishing pad surface.

12. The conditioning carrier ring of claim 7, wherein said conditioning surface includes a plurality of embedded abrasive particles adapted to abrasively roughen the surface material of said polishing pad.

13. In a chemical-mechanical polishing machine, a method of polishing a wafer, the method comprising the steps of:

a) placing a wafer onto a polishing pad of a chemical-mechanical polishing machine;

b) dispensing slurry onto said polishing pad;

c) polishing said wafer by frictionally moving said polishing pad and slurry against said wafer; and d) conditioning said polishing pad using a conditioning surface of said conditioning ring, said conditioning ring having an inner radius surface adapted to accept a second conditioning ring concentrically within said inner radius surface, said conditioning surface frictionally moving against said polishing pad as said polishing pad moves with respect to said wafer, the conditioning carrier ring having a substantially flat upper surface to accept a downforce from the chemical mechanical polishing machine onto the upper surface of the conditioning carrier ring to depress the surface of the polishing pad, wherein the downforce is independent of a downforce directed to the semiconductor wafer such that the conditioning carrier ring is vertically movable independent of the semiconductor wafer.

14. The method of claim 13 wherein step (e) further comprises the steps of:

rotating said polishing pad while said conditioning surface of said conditioning carrier ring is in contact with said polishing pad;

rotating said semiconductor wafer and said conditioning carrier ring while said semiconductor wafer is in contact with said polishing pad; and conditioning said polishing pad through the friction between said polishing pad and said conditioning surface, wherein said conditioning surface roughens the surface of said polishing pad.

* * * * *